United States Patent [19]

Colli et al.

[11] Patent Number: 5,056,727

[45] Date of Patent: Oct. 15, 1991

[54] DEVICE FOR PREVENTING YARN LOOP FORMATION AND FOR SAVING SUCTIONED YARN ON WINDING UNITS

[75] Inventors: Luigi Colli; Roberto Badiali; Luciano Bertoli, all of Pordenone, Italy

[73] Assignee: Savio S.p.A., Pordenone, Italy

[21] Appl. No.: 536,515

[22] Filed: Jun. 12, 1990

Related U.S. Application Data

[63] Continuation-in-part of Ser. No. 133,312, Dec. 16, 1987, abandoned.

[30] Foreign Application Priority Data

Dec. 23, 1986 [IT] Italy ..... 22810 A/86

[51] Int. Cl.[5] ..... B65H 54/02; B65H 54/22

[52] U.S. Cl. ..... 242/35.6 R; 242/18 R

[58] Field of Search ..... 242/35.6 R, 35.6 E, 242/35.5 R, 35.5 S, 18 R, 128, 54 R

[56] References Cited

U.S. PATENT DOCUMENTS

| | | | |
|---|---|---|---|
| 2,675,971 | 4/1954 | Abbott | 242/35.6 R |
| 2,936,130 | 5/1960 | Reiners et al. | 242/35.6 R |
| 3,059,865 | 10/1962 | Furst | 242/35.6 R |
| 3,136,494 | 6/1964 | Furst | 242/35.6 R |
| 3,279,712 | 10/1966 | Furst | 242/35.5 R |
| 3,295,775 | 1/1967 | Raasch et al. | 242/35.5 R |

FOREIGN PATENT DOCUMENTS

| | | | |
|---|---|---|---|
| 216869 | 12/1983 | Japan | 242/35.6 R |

*Primary Examiner*—Stanley N. Gilreath

*Attorney, Agent, or Firm*—Hedman, Gibson, Costigan & Hoare

[57] ABSTRACT

This invention relates to a device for preventing yarn loop formation and for saving the suctioning yarn on winding units. This device keeps the yarn under tension during the knotting and cone doffing steps. The device has a movable bar which is positioned adjacent to the upper end of a pirn during the unwinding process and which is shifted by an actuator to contact the pirn before the yarn is stopped. This is accomplished by keeping the yarn under tension from the pirn cone to a yarn-tensioning disc at the beginning ot the knotting and doffing cycles to prevent loops from forming. Additionally, this device limits the yarn consumption of the knotting cycle. By frictionally clamping the free end of the yarn with an anti-loop device, yarn is suctioned by a free yarn end feed nozzle in a shortened length thus limiting the amount of yarn removed and lost during a knotting cycle.

2 Claims, 2 Drawing Sheets

DEVICE FOR PREVENTING YARN LOOP FORMATION AND FOR SAVING SUCTIONED YARN ON WINDING UNITS

FIELD OF THE INVENTION

This application is a continuation-in-part application of commonly owned application Ser. No. 07/133,312, filed Dec. 16, 1987 of the same Applicants, now abandoned.

The present invention relates to an economical anti-loop device adapted for a cone winding unit. The device applies tension to a length of yarn which extends from a pirn to yarn tensioning disks. The tension is applied during the knotting and doffing cycles. By frictionally contacting the yarn against the pirn by means of a moveable bar, the free yarn end feed nozzle is only able to withdraw a small length of yarn by suction. This results in savings of production costs because the length of yarn which is cut and discarded during each knotting cycle is reduced.

BACKGROUND OF THE INVENTION

Automatic coner machines are an example of textile machines which have many winding stations which are positioned side by side. When yarns are unwound from pirns and are collected on a cross-turn package, they are called "cones". These cones are used in the following process steps.

During transfer, the yarn is treated to remove defects which appear in even the best spun yarns. This defect removing operation is conducted by the slub catcher. The slub catcher detects defects such as large-diameter lengths, weak points, button holes, loops, and etc. After the slub catcher detects a defect, it simultaneously cuts the yarn, stops the winding, and starts the knotting cycle. In this way, the defects that existed in the yarn are removed and replaced with knots. To make a knot an automatic device must intervene in the process. Any intervention stops the cone winding step and necessarily results in a decrease in process efficiency.

Tensioning the yarn during the winding step is known to be important because successful cone winding is largely dependent on its careful regulation. Some units which control the tension do so by applying constant tension to the feed yarn during all of the steps of the cone winding process. It is realized and understood by those skilled in the art that the tension applied to the yarn during the cone winding process is not only supplied by the tensioning units but also, to a large extent, by the winding speed. When the knotting and doffing steps occur they stop the yarn feed and consequently decrease the tension on the yarn to zero. The tension on the yarn approaches zero because the winding speed no longer contributes to supplying any tension.

In the segment of yarn between the pirn and the yarn tensioning disks, yarns which are slack or free at their ends may wind upon themselves and form loops. Then, during the restarting step of the cone winding unit, the slub catcher detects this loop as an irregularity and again intervenes thereby stopping the winding process another time. Not only does this drawback occur in the devices of the prior art but, in addition, when yarns which are more slippery are used, the feed yarn end feed nozzle suctions a longer yarn length than necessary thus causing a considerable waste of yarn.

The device of the applicants overcomes these drawbacks and solves these problems experienced by the devices of the prior art.

SUMMARY OF THE INVENTION

In accordance with the applicants' invention, an apparatus is disclosed which prevents the formation of loops in a cone winding unit during a knotting or a doffing cycle. The cone winding unit comprises a pirn cone having yarn wound upon it and a winding cone adapted to receive the yarn from the pirn cone. The apparatus comprises a bar adjacent to the pirn cone. This bar is moveable from a first position which is spaced apart from the pirn cone when the winding unit is operating at normal winding speeds to a second position. In the second position, the bar is in pressure engagement with the yarn on the pirn cone prior to stopping the yarn from winding. The apparatus also comprises an actuator connected to the bar for moving the bar from the first position to the second position. The actuator is responsive to the yarn-speed decrease in order to secure the yarn under tension on the pirn cone by means of the bar.

According to a preferred embodiment of the invention, the apparatus also comprises a free-yarn end feed nozzle. This may be actuated either simultaneous or subsequent to the movement of the bar during the knotting cycle to thereby only allow suctioning a short length of yarn due to the tension applied between the apparatus and the yarn tensioning disks. By only suctioning a short yarn length, the consumption and waste of yarn is thereby limited.

BRIEF DESCRIPTION OF THE DRAWINGS

The present invention is illustrated in the following drawings in which like reference characters indicate like parts.

DETAILED DESCRIPTION OF THE INVENTION

The following peferred embodiment as exemplified by the drawings is illustrative of the invention. It is not intended to limit the invention as encompassed by the claims of the application.

Figure 1:
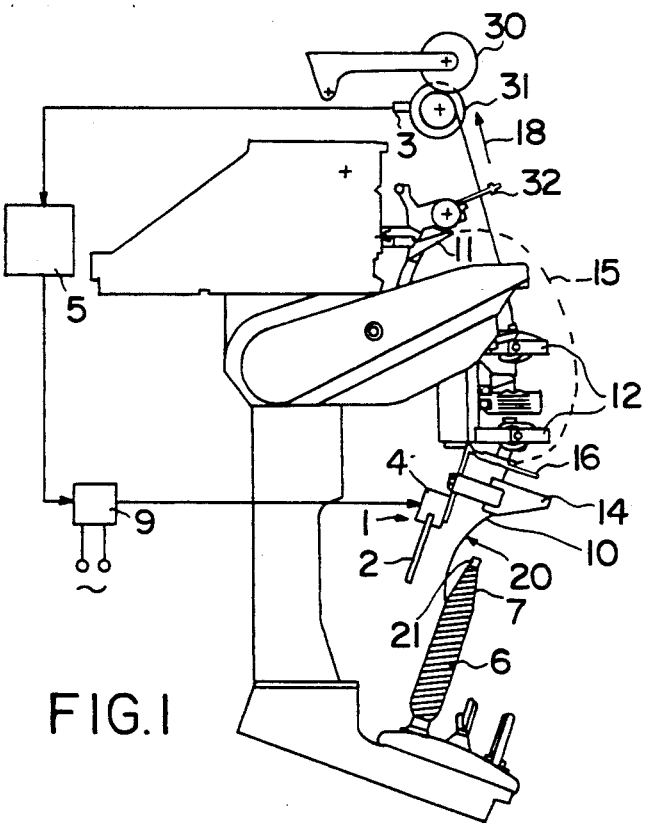
FIG. 1 is a side view of the cone winding unit showing the bar of the apparatus of the invention spaced apart from the pirn cone.

As best seen by the preferred embodiment of a cone winding unit illustrated in FIG. 1, yarn 10 is unwound from a tube 21. The tube 21 comprises a wound pirn 6 on the pirn cone 7. The yarn is fed in a direction 18 toward a winding cone or a bobbin 30 which is driven by a rotating winding cylinder 31. As the yarn 10 is unwound from the pirn 6, it forms a balloon 20 due to centrifuged force. A balloon breaker 14, also known as an unwinding accelerator is positioned above the pirn 6 on the winding unit. This balloon breaker 14 is adapted to limit the size of the balloon formed during unwinding in order to facilitate the unwinding process. Further downstream the balloon breaker 14 is a pre-slub catcher 16. The pre-slub catcher 16 blocks the loop tangles which come from the pirn 6. Downstream of the preslub catcher 16 is a yarn tensioning device 12. This yarn tensioning device 12 is adapted to keep the yarn 10 being fed under the correct tension.

Figure 2:
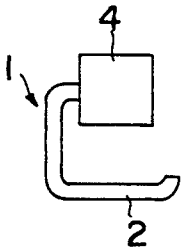
FIG. 2 is a front view of the apparatus of the invention as shown in FIG. 1.

Adjacent the pirn 6 is an anti-loop device 1 which is adapted to intervene during the knotting or doffing cycles. The anti-loop device 1 frontally illustrated in FIG. 2 has a bar 2. This bar 2 is kept in an inactive position which is spaced apart from the pirn 6 when the winding unit is operating at normal winding speeds. This position is clearly illustrated in FIG. 1. The bar 2 is driven by an electromagnetic actuator 4. However, such an actuator 4 can alternatively comprise an electrical, pneumatic, mechanical or a combination thereof.

The bobbin 30 is driven by a rotating winding cylinder 31 having grooves by means of frictional gearing. Both the bobbin 30 and the winding cylinder 31 have the same peripheral speed. This peripheral speed of the bobbin is substantially the speed at which the yarn 10 is wound upon the bobbin. The rotating speed of the winding cylinder 31 is sensed by the angular speed sensor 3 in terms of revolutions per unit time. This speed sensor 3 is a counting device which produces one pulse per revolution (or a fraction thereof) of the rotating cylinder 31. Examples of such pulse generators are photoelectric relays or capacitive or inductive proximity sensors or the like. The rotational speed of a rotating member can also be measured by a revolution counter and seconds counter, for example, a tachometer.

The angular speed sensor 3 (a transducer) sends electrical pulses to an electronic unit 5 by means of an electrical connection. This electronic unit 5 controls the various operational phases of the winding unit. The electronic unit 5 comprises an amplifier for amplifying the electrical pulses received from the sensor 3 and a filter to increase the signal to noise ratio and to protect against any possible electrical disturbances or surges. The electronic unit 5 further comprises a counter, which can be, for example, an electromagnetic or electronic type, for continuously measuring the pulse rate in Hertz. Each pulse received indicates to the electronic unit 5 that the winding cylinder 31 has rotated another revolution or fraction thereof.

The electronic unit 5 is a block of several interconnected electronic cards. Each electronic card has a printed circuit adapted for carrying out one or more operating functions. These functions, for example, may include monitoring the measured pulse rate. For example, the function of counting the number of revolutions detected by the sensor 3 in a precise time interval (minutes or seconds) to determine the rotational winding speed. An additional function compares the value of the winding speed with the monitored value L. The electronic unit 5 also comprises a card with a printed circuit which operates a progressive counting of the number of revolutions of the winding cylinder 31 for the purpose of detecting the whole length of yarn which is wound upon the forming bobbin 30. When the length reaches a value equal to a prefixed value which is set in the unit 5, the diameter of the bobbin 30 will correspond to the diameter of the completed bobbin. The winding will therefore be stopped to remove the bobbin by means of the doffing cycle. Activation of the doffing cycle involves the zero setting of the progressive counting of the number of revolutions of the winding cylinder 31. This is to restart the winding to form a new bobbin. The determination of the diameter of the bobbin 30 takes place by means of counting the number of revolutions of the winding cylinder by an electronic card of the control unit 5.

Figure 4:
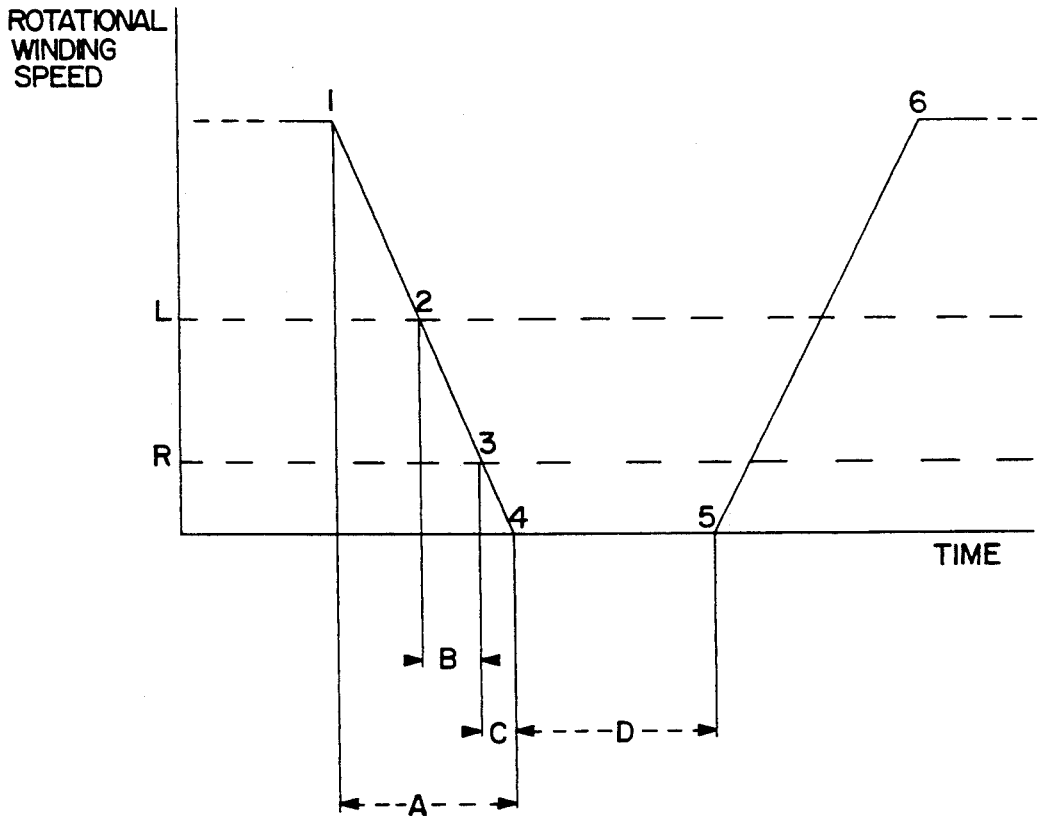
FIG. 4 is a graphical representation of the relationship of rotational winding speed to time.

In the preferred embodiment, the counter in the electronic control unit 5 measures the pulse rate and continuously compares it with a preselected limiting threshold value. This value is recorded within the circuitry of the electronic control unit 5. The threshold value represents the numerical value of the rotary pulses (in Hertz, for example) which correspond with the limiting rotary winding speed L (as represented in FIG. 4). This value L is fed into the memory circuit of the control unit by the operator. The speed of rotation is continuously detected by the sensor 3 by sensing the rate of electrical pulses. When the rate of electrical pulses decreases below a given preselected value (L), the electronic control unit 5, sends an electrical signal to activate an electrical power supply 9 for supplying electric power to operate the actuator 4.

Figure 3:
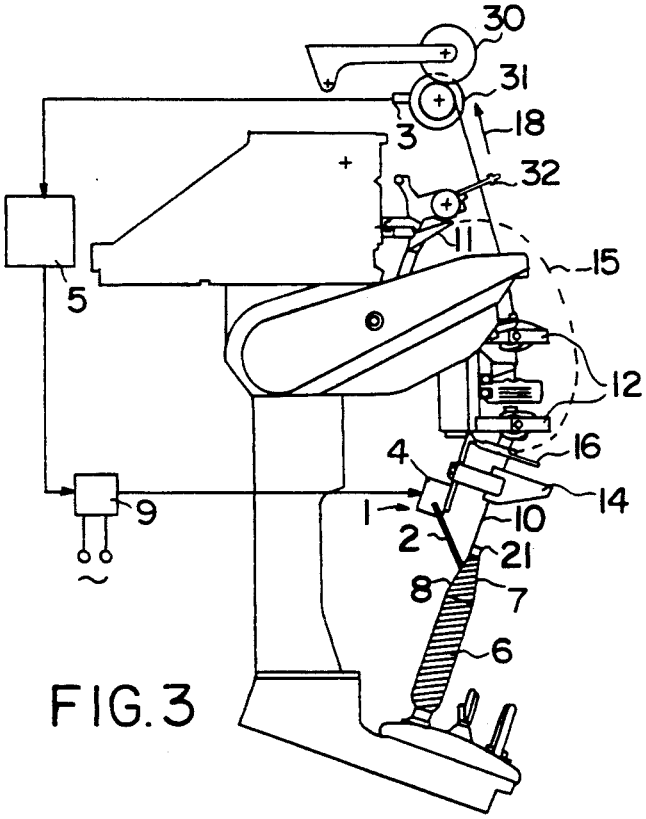
FIG. 3 is a side view of the cone winding unit showing the bar of the apparatus of the invention in pressure engagement with the pirn cone.

Actuation of the actuator 4 moves the bar 2 into contact with the yarn 10 on the pirn 6 (as shown in FIG. 3) as the yarn continues to move in the direction 18. The elapsed time between when the electrical pulses are sensed to equal the limiting threshold rate and the actual contact of the bar 2 upon the yarn 10 must be less than the time that elapses for the roller 31 to go from the rotational speed L to zero.

After the bar 2 moves from a position spaced apart from the pirn 6 into another position contacting the yarn 10 on the pirn 6, the drawing roller 31 is stopped from rotating. This results in the cessation of generated electrical pulses by the sensor 3. Therefore, at this time no signals are received by the control unit 5. Thus, the bar 2 must make contact with the yarn 10 upon the pirn 6 before the roller 31 has stopped rotating and thus before the yarn has stopped moving.

The precise time needed must be determined empirically with each machine due to many factors dependent on individual installations. This total time is also dependent upon intrinsic functional characteristics of the various components which are sequentially activated. Additionally, the value L is dependent on the braking time of the roller 31. For this reason, the limiting rotational speed L must necessarily be determined by operating the equipment on which the device of the present invention is to be used.

The electromagnetic actuator 4 is activated throughout the entire period when the electronic control unit 5 is receiving pulses at a rate below the limiting threshold rate. (This corresponds to the rotary winding speed L.) Therefore, the bar 2 remains in contact with the yarn 10.

To restart winding, the drive roller 31 begins to rotate thus rotating the overlying bobbin 30. The progressively increasing rate of rotation is sensed by the sensor 3 which generates a pulse rate corresponding with this rotation rate. The electronic control unit 5 receives and continuously monitors these pulses.

The moment the pulse rate exceeds the limiting threshold rate, (L) the comparison circuit of the control unit 5 produces a signal which deactivates the electromagnetic actuator 4 by means of a tripping circuit. This deactivation of actuator 4 moves the bar 2 from the position contacting the yarn 10 against the pirn 6 to a position spaced apart from the pirn.

A diagram representing the control logic of the movement of the bar 2 is represented below:

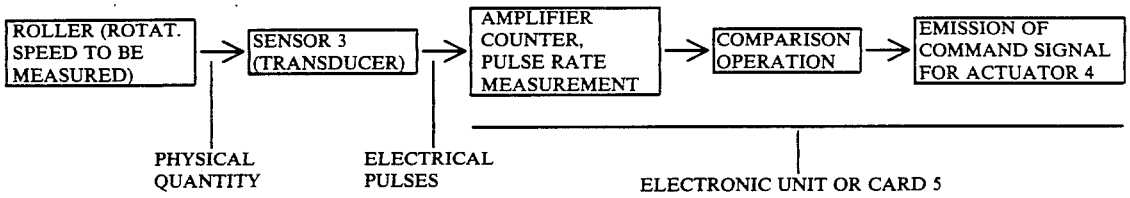

Control unit 5 also receives other signals. For example, a device for clearing yarn from the yarn path, a device for sensing the presence of moving yarn, a device for monitoring the diameter of the bobbin under formation, and other sensors can all send signals to the control unit 5 for further controlling functions.

These devices, as is well known in the art, are all for monitoring the yarn at all stages as it moves from the pirn 6 to the bobbin 30.

FIG. 4 graphically illustrates the critical operational phases of the device of the applicants. The point 1 represents the commencement of braking the roller 31. This occurs either during the doffing or the knotting cycle, or, anytime the yarn feed operation is interrupted. The point 2 illustrates the intersection of the rotational speed of the roller and the limiting threshold rate. Therefore, this is the point in time at which the rotation of the braking roller equals the value which is set as the limiting value. The point 2 also represents the moment when the electronic control unit 5 sends a signal to activate the actuator 4 of the bar 2. The point 3 shows the intersection of the rotational speed of the roller and the residual speed of the roller. It is therefore the point in time when the bar 2 contacts the yarn 10 on the pirn 6 while the yarn is still moving in the direction 18 due to the residual speed of the roller. Thus, the line form the point 1 to the point 4 is a substantially straight line gradient corresponding to the length of time represented by the distance A. The time between the point 2 and the point 3 is represented by the distance on the time scale of B. The time interval "B" of FIG. 4 is the time taken by the bar 2 to shift from the rest position of FIG. 1 to the contact position with the yarn 10 of FIG. 3. The time period represented by C is the elapsed time between the bar 2 contacts the yarn 10 while the yarn is still moving. The time period represented by the period D is the time during which the doffing cycle or the knotting cycle takes place. No yarn movement takes place during this time period. The time from the point 5 to the point 6 represents the rotational acceleration gradient of the roller as the winding unit resumes its full winding speed.

When the bobbin has finished winding and reaches its final diameter, a device generates and sends an electrical signal to the control unit 5. The control unit 5 thereupon activates the control circuitry controlling the doffing cycle. The doffing cycle comprises a series of operating steps. The first step of the doffing cycle comprises braking the drive roller 31. Before the rate of rotation reaches zero, the actuator 4 is activated in accordance with the control sequence as controlled by control unit 5.

The mobile suction nozzle 11 is not activated during the doffing cycle and it remains in its rest position. When the doffing cycle is completed the winding unit is restarted so that yarn may be wound upon a new bobbin. When the winding unit is restarted the actuator 4 is deactivated in accordance with the above-described control sequence.

If the yarn is broken for any reason, the yarn presence sensor 32 immediately generates and sends a signal to the control unit 5. When the control unit 5 receives this signal from the yarn presence sensor 32 indicating that the continuity of the yarn has been interrupted, the control unit 5 activates a circuit for controlling a knotting cycle.

The knotting cycle comprises a series of operating steps. These steps are controlled by the control unit 5 which activates the various devices necessary to perform the knotting cycle. The first step of the knotting cycle comprises braking the drive roller 31. Either during the braking or when the braking has completed, the suction nozzle 11 is moved along path 15. The suction nozzle 11 can be moved by a variety of devices. For example, the suction nozzle can be moved by a lever system which takes its motion from the drive shaft. Alternatively, the suction nozzle can be moved by its own individual motor. In either case, the suction nozzle 11 is moved along the path 15 shown in FIGS. 1 and 2, and is activated to intake by suction the lower end of the yarn which lies proximate to the yarn tensioner 12, or immediately above the pre-slub catcher 15. The captured lower end of the yarn is then brought to and inserted in the knotting device in order to restore the continuity of the yarn. Before the rotation of the bobbin 30 reaches zero during this braking step, the actuator 4 is activated to contact the yarn in accordance with the sequence of operations as controlled by the control unit 5.

When the knotting cycle has completed, and the ends of the yarn have been rejoined so that the yarn has become continuous, the winding device is restarted. Thereupon, the electromagnetic actuator 4 moves the bar 2 from its position in contact with the yarn, to a position spaced apart from the pirn as controlled by control unit 5.

What we claim is:

1. An apparatus for preventing the formation of loops as yarn is wound in a cone winding unit when the cone winding unit stops winding, said cone winding unit comprising a pirn with wound yarn thereon, a bobbin adapted to receive the yarn unwound from the pirn, means for operating the winding unit at normal winding speeds, and stopping means for stopping the cone winding unit said apparatus comprising:

a) a sensor positioned adjacent the winding unit for detecting the speed of the yarn wound thereon and for sending a signal when the speed of the yarn wound decreases;

b) a bar positioned adjacent the pirn and moveable from a first position spaced apart from the pirn when the winding unit is operating at normal winding speeds to a second position in pressure engagement with the yarn on the pirn prior to the stopping of yarn winding; and c) an actuator connected to said bar for said movement of said bar from said first position to said second position, wherein said actuator is responsive to said signal when the speed of the yarn wound by the winding unit decreases by the stopping means so that the yarn is secured on the pirn by means of said bar in said second position.

2. The apparatus of claim 1, wherein the cone winding unit further comprises a knotting means for operation during a knotting cycle and further comprising retention means for retaining a free end of the yarn spaced apart from the pirn cone under tension during the knotting cycle.

* * * * *